US009701374B2

(12) United States Patent
Udupi et al.

(10) Patent No.: US 9,701,374 B2
(45) Date of Patent: Jul. 11, 2017

(54) SELF-RIGHTING DEVICE FOR LIFE RAFT

(71) Applicant: Winslow Marine Products Corporation, Lake Suzy, FL (US)

(72) Inventors: Aashik Udupi, Karnataka (IN); Ashish Kumar Agarwal, Karnataka (IN)

(73) Assignee: WINSLOW MARINE PRODUCTS CORPORATION, Lake Suzy, FL (US)

( * ) Notice: Subject to any disclaimer, the term of this patent is extended or adjusted under 35 U.S.C. 154(b) by 0 days.

(21) Appl. No.: 15/058,284

(22) Filed: Mar. 2, 2016

(65) Prior Publication Data

US 2017/0029080 A1 Feb. 2, 2017

(30) Foreign Application Priority Data

Jul. 27, 2015 (IN) ..... 3841/CHE/2015

(51) Int. Cl.
*B63B 35/58* (2006.01)
*B63B 43/06* (2006.01)
*B63C 9/04* (2006.01)

(52) U.S. Cl.
CPC ..... *B63B 43/06* (2013.01); *B63C 9/04* (2013.01); *B63C 2009/048* (2013.01)

(58) Field of Classification Search
CPC ..... B63B 43/04; B63B 43/06; B63B 2043/04; B63C 9/02; B63C 9/04; B63C 2009/02; B63C 2009/023; B63C 2009/04; B63C 2009/042; B63C 2009/044; B63C 2009/046
USPC ..... 441/35, 37, 36, 40, 41; 114/121, 122, 114/124, 125, 345, 348–350, 360
See application file for complete search history.

(56) References Cited

U.S. PATENT DOCUMENTS

| | | | | |
|---|---|---|---|---|
| 2,417,508 | A | 3/1947 | Leyde | |
| 3,155,992 | A | 11/1964 | Shewmake et al. | |
| 3,736,607 | A | 6/1973 | Radnofsky et al. | |
| 4,561,370 | A * | 12/1985 | Sanford | B63B 1/04 114/125 |
| RE32,560 | E * | 12/1987 | Givens | B63C 9/06 114/125 |
| 4,919,067 | A | 4/1990 | Wenstob et al. | |
| 4,998,900 | A | 3/1991 | Wright | |
| 5,800,225 | A | 9/1998 | Shoaff, III | |
| 5,921,830 | A | 7/1999 | Shoaff, III | |
| 5,927,228 | A * | 7/1999 | Richard | B63B 43/14 114/345 |
| 5,967,869 | A | 10/1999 | Wiggins | |
| 6,685,520 | B1 | 2/2004 | Wiggins | |
| 2002/0166494 | A1 * | 11/2002 | Inglis | B63C 9/06 114/345 |

(Continued)

FOREIGN PATENT DOCUMENTS

CN 202807069 3/2013

*Primary Examiner* — Daniel V Venne
(74) *Attorney, Agent, or Firm* — Cantor Colburn LLP

(57) ABSTRACT

A life raft is provided having a base having a top side and a bottom side, one or more buoyancy elements attached to the top side of the base, and a righting-device attached to the bottom side of the base, the righting-device is configured to shift a center of gravity of the life raft. When the life raft is subject to an instability event, the righting-device is configured to provide a shifted center of gravity such that a righting moment is generated to automatically return the life raft to an upright position.

11 Claims, 4 Drawing Sheets

(56) References Cited

U.S. PATENT DOCUMENTS

2014/0087610 A1* 3/2014 Rasmussen ..... B63B 7/08
441/37

* cited by examiner

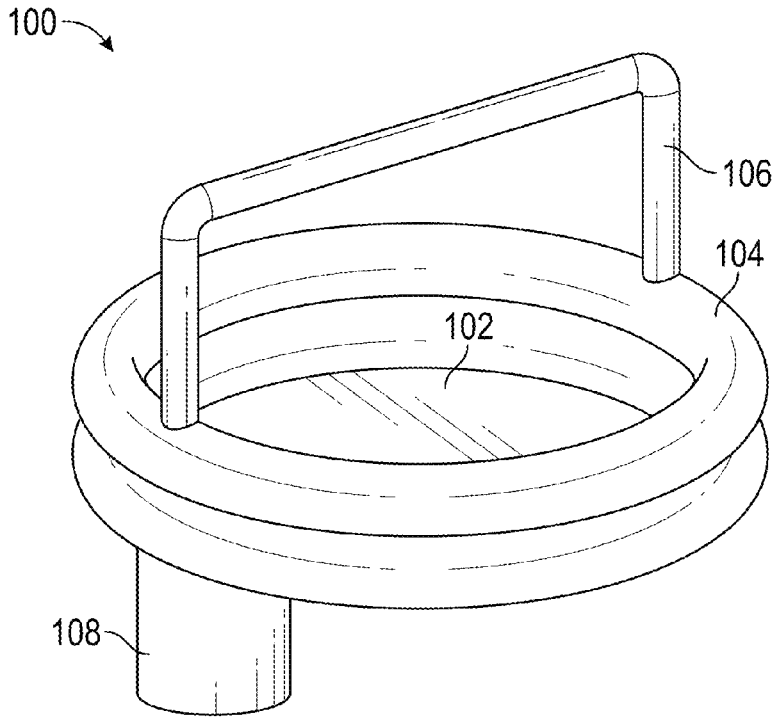
FIG. 1
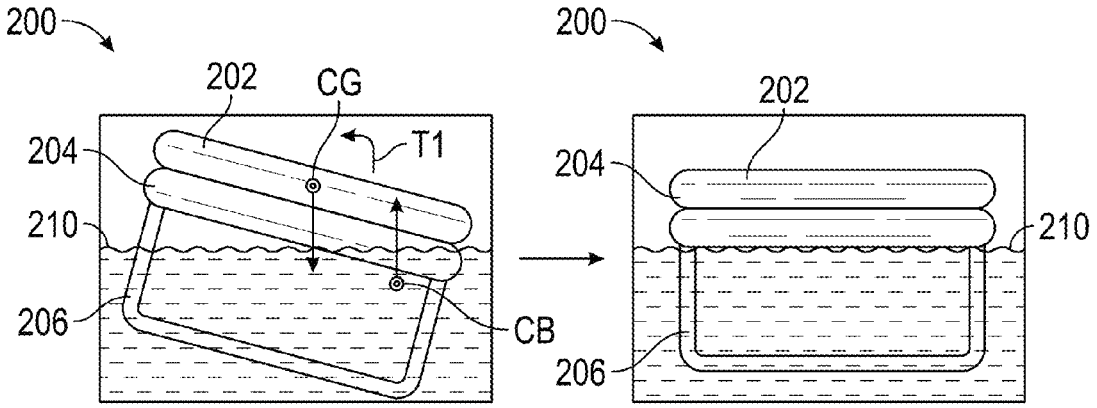
FIG. 2A
PRIOR ART
FIG. 2B
PRIOR ART

SELF-RIGHTING DEVICE FOR LIFE RAFT

CROSS REFERENCE TO RELATED APPLICATIONS

This application claims priority to Indian Patent Application No. 3841/CHE/2015 filed Jul. 15, 2015, the entire contents of which is incorporated herein by reference.

BACKGROUND

The subject matter disclosed herein generally relates to life rafts and, more particularly, to stabilizing and self-righting features for life rafts.

Single sided life rafts may be susceptible to be tipped and/or overturned under the action of strong wind forces and/or wave forces. If this occurs, the life rafts may become tilted and/or flipped-over or inverted. Traditionally, if the life rafts are inverted on the surface of the water due to any external disturbance, there is no built-in mechanism to automatically bring it back to an upright or stable position. If the life raft cannot be made upright, a danger to the life of the occupants may be posed. Some prior solutions exist with a configuration or mechanism to manually force the life raft into an upright position. Some such solutions include a righting-cord which is engaged by a person manually pulling on the righting cord that may be provided on an underside of the life raft. However, because the process of pulling the righting-cord requires manual intervention, the success of an up-righting process may be cumbersome and/or may depend on the situation and/or an individual's skill and capacity to overturn the life raft.

SUMMARY

According to one embodiment, a life raft is provided having a base having a top side and a bottom side, one or more buoyancy elements attached to the top side of the base, and a righting-device attached to the bottom side of the base, the righting-device is configured to shift a center of gravity of the life raft. When the life raft is subject to an instability event, the righting-device is configured to provide a shifted center of gravity such that a righting moment is generated to automatically return the life raft to an upright position.

Technical effects of embodiments of the present disclosure include providing a life raft having an automatic stabilizing feature configured to upright the life raft in response to an instability event.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

FIG. 1 is a schematic isometric view of a life raft in accordance with embodiments of the present disclosure;

FIG. 2A is a schematic illustration of the forces acting on a prior art configuration life raft during an instability event;

FIG. 2B is a schematic illustration of the prior art configuration life raft shown in FIG. 2A after the instability event;

DETAILED DESCRIPTION

Figure 3A:
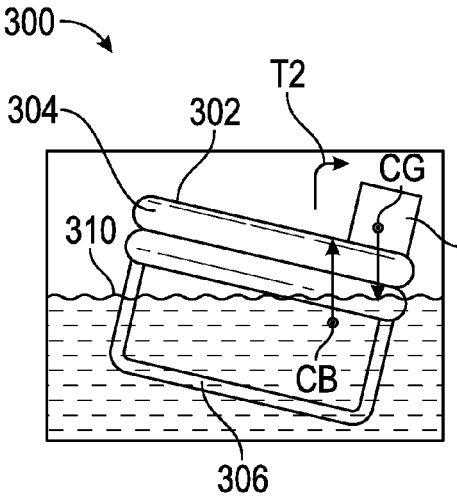
FIG. 3A is a schematic illustration of the forces acting on a life raft configured in accordance with embodiments disclosure herein during an instability event.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. 1 may be labeled "1*a*" and a similar feature in FIG. 2 may be labeled "2*a*." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a schematic isometric view of a life raft in accordance with embodiments of the present disclosure. The life raft 100 is a self-righting or automatically righting life raft that is configured to correct its orientation during an instability event. As used herein, an instability event is an event, occurrence, situation, etc., that changes the center of gravity of the life raft such that the life raft may tip, flip-over, or invert, i.e., an event that shifts the life raft from a normal, flat, stable position. Instability events may include, but are not limited to, strong winds and/or wave forces that can shift and change the orientation of the life raft.

Embodiments of life rafts disclosed herein provide a self-righting life raft that does not require manual operation to physically right or flip the life raft over during or after an instability event. As shown in FIG. 1, the life raft 100 includes a base 102, buoyancy elements 104 attached to a top side of the base 102, and a canopy 106 attached to the buoyancy elements 104. The base 102 is configured to support passengers within the life raft 100 and operate as a floor or similar surface to keep passengers out of water. The buoyancy elements 104 may be configured as tubes and are configured to provide buoyancy to the life raft 100 and further are configured to define a side wall to contain passengers within the life raft 100. The canopy 106 is configured to support a tarp or other structure to protect passengers that are within the life raft 100. For example, the canopy 106 may be used, in combination with other components, to protect passengers from rain, strong sun, winds, etc. In some embodiments, the canopy 106 may also provide structural support and/or rigidity to the life raft 100.

Further, as shown in FIG. 1, a righting-device 108 is attached on an underside or bottom of the base 102 of the life raft 100. The righting-device 108 may be bonded, sewn, glued, or otherwise attached to the base 102 of the life raft 100. The righting-device 108 may be formed from plastics, polymers, etc., and in some embodiments may be formed from the same material as the life raft 100.

The righting-device 108 is configured to define or house a water chamber that may be stowable when not in use. The water chamber may be filled and engaged when needed. The righting-device 108 is effective as a self-righting device when it is filled with water. For example, when the life raft 100 is deployed on water and is in an upright, normal condition, hereinafter "stable condition," the righting-device 108 is configured to be below the surface of the water (ocean, river, lake, etc.). The righting-device 108 is configured to not impact the operability or stability of the life raft 100 when the life raft 100 is in the stable condition, regardless of whether the water chamber is filled with water or not. To operate as an automatic righting device, the righting-device 108 may be filled with water.

When the life raft 100 suffers from an instability event and is tipped or inverted, the righting-device 108 may come out of the water and acts as a weight that may act to stabilize and right the life raft 108. As noted, the weight of the righting-device 108 is supplied by water filling into the righting-device 108. The righting-device 108 may be configured as an expandable chamber that can collapse to a first state, such as a stowage state, and be filled with water to achieve a second state, such as a deployed state. When the life raft 100 is inverted, with the righting-device 108 out of the water, the righting-device 108 is configured to retain the water within the righting-device 108 without leaking or draining and provide a weight or force at the location of the righting-device 108. That is, the righting-device 108 defines a sealed or sealable chamber that may be filled.

The righting-device 108 may be configured to fill with water automatically when the life raft 100 is deployed and/or inflated or may be configured to be filled by a manual actuation or action. For example, in some embodiments, when the life raft 100 is first deployed and inflated, a valve, such as a two-way check valve, or other type of valve, that is part of the righting-device 108 may be configured to be opened to allow water to enter a chamber of the righting-device 108. In such embodiments, once the chamber is filled, the water and/or water pressure within the chamber, or other mechanism, may ensure that the valve remains closed and the water within the chamber is trapped or sealed therein. In other embodiments, a person may manually open a valve on the righting-device 108 to allow water to enter a chamber of the righting-device 108.

When the righting-device 108 is filled with water and the life raft 100 is subject to an instability event, the righting-device 108 may stabilize the life raft 100 or, if a complete inversion of the life raft 100 occurs, the righting-device 108 may automatically right the life raft 100. The automatic stabilizing occurs due to a shift in the center of gravity of the life raft 100 as a result of the weight of the filled righting-device 108. The shift in the center of gravity can provide a righting torque to overturn and/or right the life raft 100.

Figure 3B:
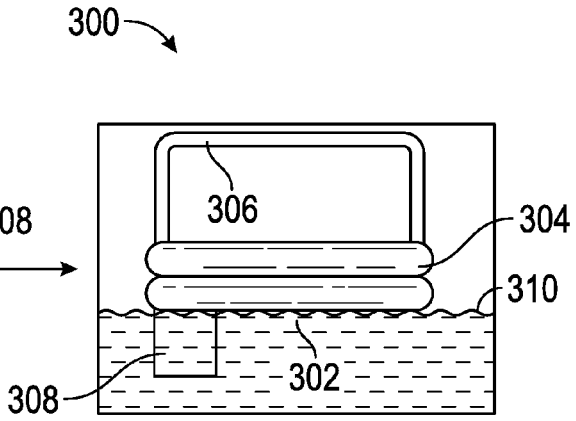
FIG. 3B is a schematic illustration of the life raft of FIG. 3A after the instability event.

For example, with reference to FIGS. 2A, 2B, 3A, and 3B, schematic diagrams of the forces acting on life rafts are shown. FIG. 2A shows the forces acting on a life raft 200 that does not include a righting-device in accordance with embodiments disclosed herein during an instability event. FIG. 2B shows the end result configuration of the life raft 200 after the instability event of FIG. 2A. FIG. 3A shows the forces acting on a life raft 300 that includes a righting-device in accordance with embodiments disclosed herein during an instability event. FIG. 3B shows the end result configuration of the life raft 300 after the instability event of FIG. 3A.

As shown in FIG. 2A the life raft 200 is inverted and tilted with respect to a water line 210. In this case, a base 202 is above the water line 210 and a canopy 206 is below the water line 210. Buoyancy elements 204 are upside down, such that the passenger area within the buoyancy elements 204 is not usable.

The center of gravity of the life raft 200 is shown by the point CG. The center of gravity CG of life raft 200 is in the center of the life raft 200. The center of buoyancy of the life raft 200 is shown by the point CB. In the state of instability shown in FIG. 2A, the center of buoyancy CB is off center. In a stable state, the center of gravity CG and the center of buoyancy CB will be in the same location or at least vertically aligned such that the life raft 200 remains upright and in the stable position.

However, as shown in FIG. 2A, and as will be appreciated by those of skill in the art, the force arrow directed from the center of gravity CG and the force arrow directed from the center of buoyancy CB are not equalized and off-setting each other, thus preventing a stable situation, but rather forcing an inverted situation. In fact, the downward force of gravity is displaced from the upward force of buoyancy, such that a torque T1 is applied. The torque T1 generates a turning effect in a counter-clockwise direction in the configuration and situation shown in FIG. 2A. It will be appreciated that the two forces generate a couple in a counter-clockwise direction such that a particular result will happen.

As a result of the forces acting on the life raft 200 and the torque T1, the life raft 200 will end up being positioned as shown in FIG. 2B. As shown in FIG. 2B, the life raft 200 ends up being inverted and unusable. Any user of the life raft 200 will have to manually, and with difficulty, upright the life raft 200 to be able to use it. Part of the difficulty of manually uprighting a life raft is indicated by the force arrows shown in FIG. 2A, wherein when a user lifts one side of the life raft 200 up, they will need to act against both the force of gravity and the buoyancy force to upright the life raft 200.

In contrast to the situation of FIGS. 2A and 2B, embodiments disclosed herein enable automatic stabilizing and righting of a life raft that is made unstable by an instability event. As shown in FIG. 3A, a life raft 300 includes a base, 302, buoyancy elements 304, a canopy 306, and a righting-device 308, as described above. The starting instability position of life raft 300 is the same as that in FIG. 2A for life raft 200. However, because of the righting-device 308, the forces acting on the life raft 300 and the end result as shown in FIG. 3B is changed.

As indicated by the location of center of gravity CG in FIG. 3A, the forces acting on the life raft 300 are modified as compared to a life raft without the righting-device 308 (e.g., FIG. 2A). The weight of the righting-device 308 is sufficient to move the center of gravity CG to the opposite side of the center of buoyancy CB as compared to FIG. 2A. As a result, the two forces generate a couple in the clockwise direction, torque T2. The clockwise rotation generated by torque T2 results in the life raft 300 to be righted, with the canopy 306 above a water line 310 and the righting-device 308 below the water line 310.

Figure 4A:
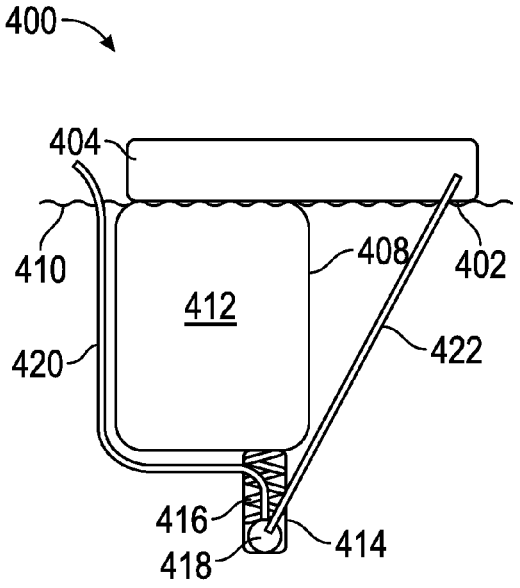
FIG. 4A is a schematic illustration of a stability feature of a life raft in accordance with an embodiment of the present disclosure in a first state.
Figure 4B:
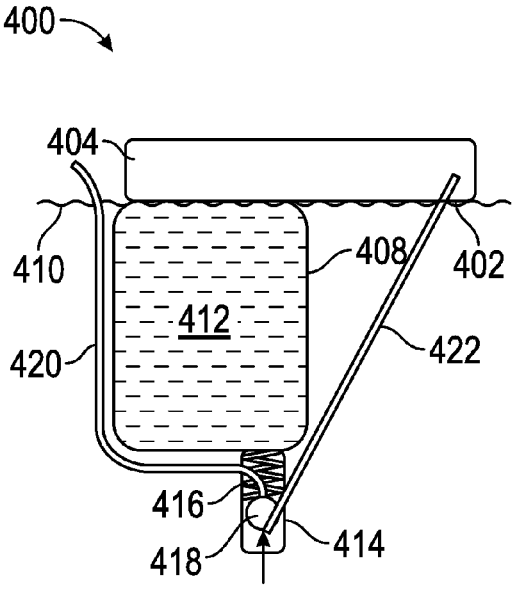
FIG. 4B is a schematic illustration of the stability feature of FIG. 4A in a second state.

Turning now to FIGS. 4A and 4B, an example of operation of a righting-device as described herein is shown. A righting-device 408 may be located on a bottom surface of a base 402 of a life raft 400. The life raft 400 may include one or more buoyancy elements 404. The righting-device 408 defines a chamber 412 that may be sealed and may be configured to contain water. The chamber 412 of the righting-device 408 may be filled with water by operation of a valve 414. As shown in FIG. 4A, the valve 414 is a two-way check valve that includes a biasing mechanism 416 which biases a valve element 418 between a first position and second position. The biasing mechanism 416 may be a spring, an elastic mechanism, a gravity assisted mechanism, or other biasing element or structure that is configured to be biased such that the valve element 418 may be biased in a first position (FIG. 4A). The valve element 418 may be a ball, a flap, an interference fit structure, or other structure or element that is configured to be closed when in the first position. The first position may be a closed position of the valve 414 such that water may not pass through the valve 414. When the biasing mechanism 416 is biased to the second position (FIG. 4B), the valve 414 is in the open position and water may pass through the valve 414 into the chamber 412 or out of the chamber 412.

Operation of the valve 414 may be achieved automatically or manually. In the example shown in FIGS. 4A and 4B, the valve 414 is configured to be operated manually. A user may pull on an operating cable 420. An optional supporting cable 422 may be configured to support the reaction of the operation of the valve 414 and the biasing force of the biasing mechanism 416. When a person pulls on the operating cable 420, the biasing mechanism 416 will be transitioned from a first state to a second state, e.g., from a closing biasing state to an open biasing state. This enables the valve element 418 to move to a position or state that enables water to pass by or through the valve element 418. For example, as shown in FIG. 4B, an arrow indicates an upward displacement of the valve element 418 within the valve 414. With the valve element 418 displaced upward, water may enter the chamber 412 to fill it.

Once the chamber 412 of the righting-device 408 is filled, the valve 414 may be returned to the first position (closed) and/or locked, thereby sealing and storing the water in the chamber 412. The locking may be effected by water pressure within the chamber 412 acting on the valve element 418 or may be some other locking mechanism (not shown), such as a mechanism activated by another cable that engages a locking mechanism of the valve 414. In some embodiments, a fully filled chamber 412 may be configured to have a weight of about 700 N when it is outside water, to thus provide the shift in the center of gravity of the life raft to which it is attached.

As will be appreciated by those of skill in the art, in some embodiments, the chamber 412 can be drained or emptied by operating the valve 414, at will, by pulling on the operating cable 420 and pulling the righting-device 408 out of the water. When out of the water, the valve 414 may be opened and allow for the water to drain from the chamber 412. In other embodiments, when the operating cable 420 is pulled or operated the valve 414 may be opened and water may drain out of the chamber 412. Simultaneously, the righting-device 408 may be pulled out of the water, as the weight of the righting-device 408 is reduced as water exits the chamber 412. Once removed and empty, the righting-device 408 may be stowed or stored.

In other embodiments, the valve 414 may be automatically controlled by a controller which may include electronics, a motor, or other devices. The controller may be configured to both fill and drain the chamber 412 of the righting-device 408.

Figure 5:
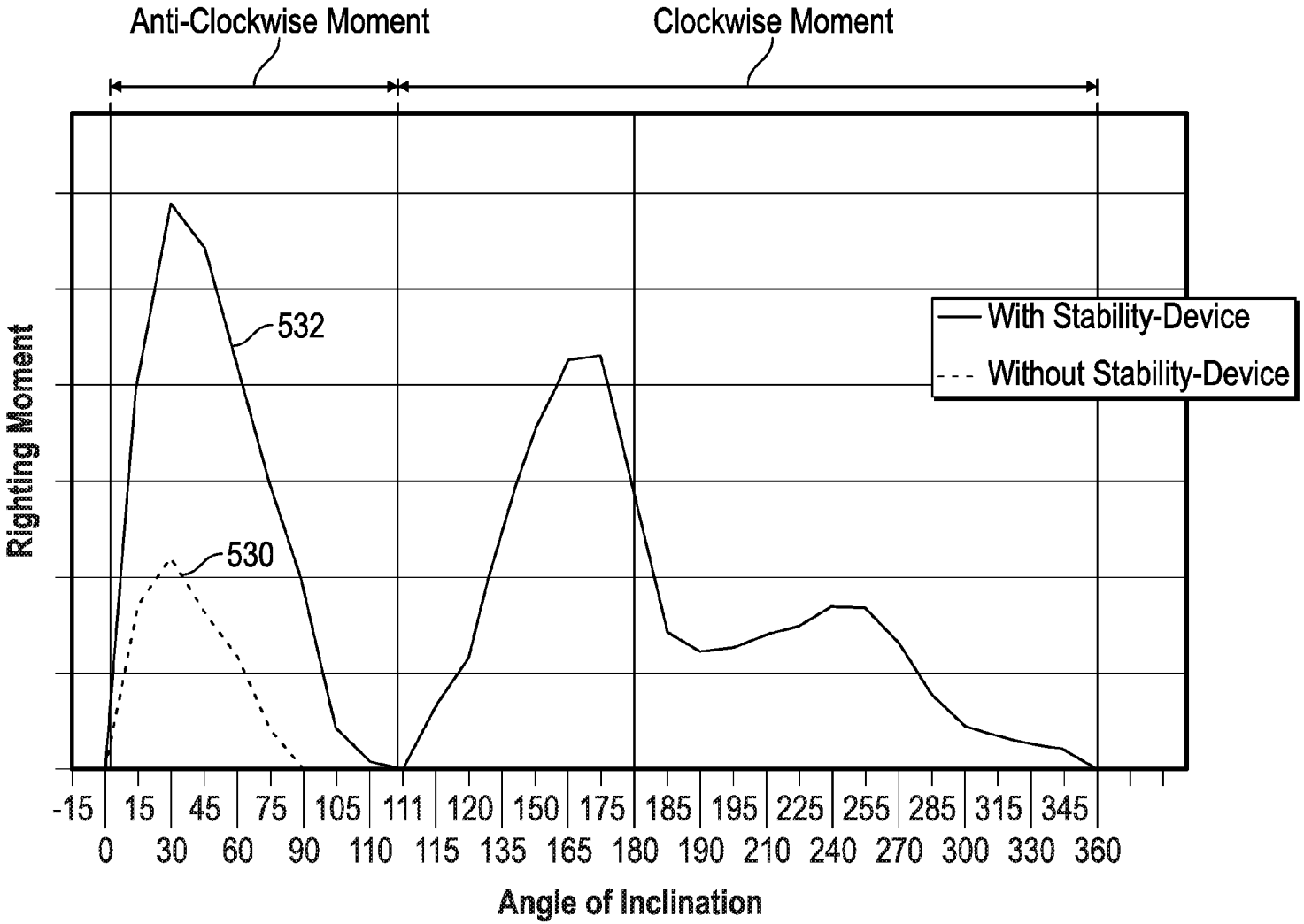
FIG. 5 is a plot of the righting moment comparing prior art configuration life raft and a life raft configured in accordance with the present disclosure.

Turning now to FIG. 5, a plot of the righting moment comparing a life raft configuration without a righting-device as disclosed herein and a life raft configured with a righting-device as disclosed herein is shown. The horizontal axis is the angle of inclination of a life raft with respect to a surface of water. The vertical axis is the righting moment. As known in the art, the righting moment is a moment that tends to restore a vessel to its previous attitude after any small rotational displacement—called also restoring moment.

The line 530 indicates the magnitude of the righting moment of a life raft without a righting-device as disclosed herein installed thereon. As shown, the righting moment for such a life raft is generated for only about 0° to about 90° of tilt. Outside of this range, the life raft of line 530 will remain inverted or completely flip over and end up being upside down. In contrast, the line 532 indicates the magnitude of the righting moment of a life raft having a righting-device as disclosed herein installed thereon and in the filled or deployed state. As shown, the righting moment for such a life raft is generated over the full 360° of inclination of the life raft. Thus, as is apparent from the plot of FIG. 5, adding the features of the righting-device disclosed herein to a life raft ensures righting moment at all angles of inclination of a life raft that is made unstable, such as during an instability event. As indicated at the top of FIG. 5, the righting-device can apply an anti-clockwise moment between 0° and about 111° of inclination, and a clockwise moment between about 111° and 360° of inclination.

As illustrated by the anti-clockwise moment, a life raft with a configuration as described herein may provide an increased resistance to overturning at a particular orientation of the life raft when it is floating or upright during an instability event. That is, the magnitude of anti-clockwise moment of a life raft in accordance with embodiments described herein is greater than the magnitude of anti-clockwise moment of a life raft without a righting-device. For example, if a wind force is acting upon the portion of the life raft that includes the righting-device, the righting device may come out of the water and act as a weight, thus resisting overturning.

Figure 6:
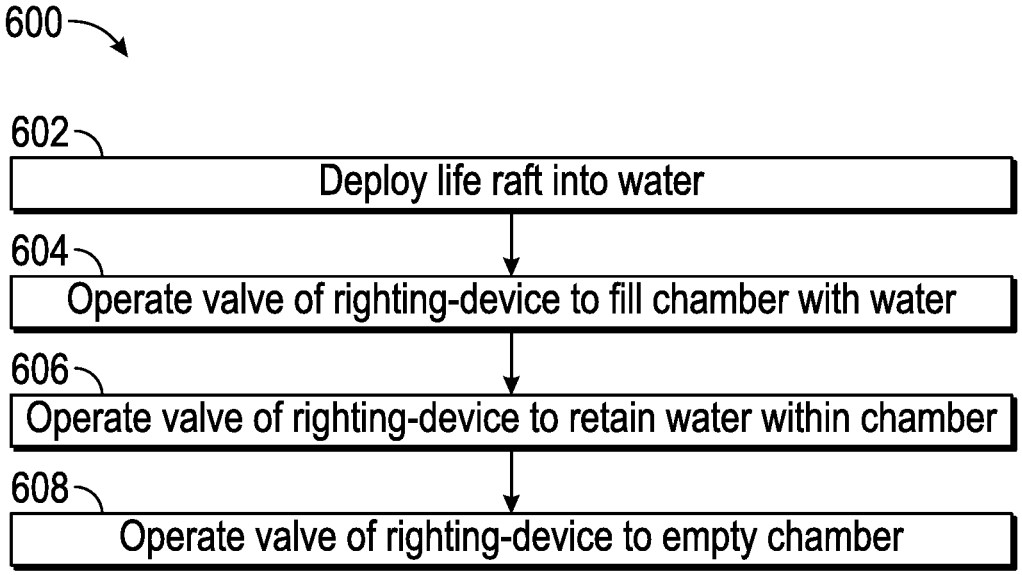
FIG. 6 is a process of providing stability and engaging an automatic righting-device of a life raft in accordance with the present disclosure.

Turning now to FIG. 6, a process of providing stability and engaging an automatic righting feature of a life raft in accordance with the present disclosure is shown. Process 600 may be employed with a life raft similar to that shown and described above, although other configurations of life rafts may be used with a life raft having a different construction or configuration but installed or equipped with a righting-device similar to that described above. In such configurations, the righting-device may have a different configuration that is optimized or tailored to the specific construction and design of the life raft.

At step 602, a life raft may be deployed into water. This may occur during an emergency or other event where a life raft may be needed for the safety or securing of persons. In some embodiments, the deployment of the life raft into the water may occur automatically. In other embodiments, the deployment may be a manual process. After step 602, a life raft will be inflated and deployed and floating on water. People in need may be able to climb into the life raft for their safety.

At step 604, to prevent the life raft from tipping over or to self-right in the event of an inversion, a person may operate or engage a righting-device that is attached to the life raft to fill the righting-device with water. The operation may be performed from within or outside of the life raft by a person. In some embodiments, the operation of the righting-device may be a manual operation wherein a person may pull on a cord or cable, unscrew a cap, or perform another type of operation to open a valve that is part of the righting-device. In other embodiments a motor or other automated device may be activated to pump or allow water into a chamber or to open a valve to allow water to passively flow into a chamber of the righting-device. During this operation, water may enter the chamber of the righting-device thus filling up. As described above, the filled righting-device may provide additional weight to the life raft to thus shift the center of gravity of the life raft in the event of overturning of the life raft.

At step 606, the righting-device may be manipulated to prevent any water within the chamber of the righting-device to leak or leave the chamber. That is, an operation may be performed to secure the water within the righting-device. For example, if a valve is present on the righting-device, the valve may be closed so that water cannot enter or leave the chamber of the righting-device. In other embodiments, a sealing, seal, plug or other sealing device or feature may be applied or activated to secure the righting-device in a closed state to retain the water within the righting-device. In this state the righting-device may provide the functions and benefits described above.

At step 608, the righting-device, or a component thereof, may be operated to drain or empty the chamber of the righting-device of water. This may be an action of opening the same or a different valve that was used to fill the righting-device at step 604. The water may be drained from the chamber of the righting-device. This may be done for the purpose of removing any potential drag during rowing of the life raft that may be generated by the presence of a filled chamber beneath the life raft or may be done to repack or re-stow the life raft after use.

Advantageously, embodiments described herein provide a righting-device attached to a life raft which acts as a stabilizing weight when the life raft is upright and acts as a self-righting device when the life raft is inverted or displaced from upright. Furthermore, advantageously, when the life raft is upright, the effect of righting-device on the life raft is negligible. Thus, the presence of the righting-device doesn't affect the overall stability, usability, or safety of system. Advantageously, when the life raft is overturned, due to the shift in the center of gravity generated by the righting-device a righting torque is generated to upright the life raft, hence making the life raft self-righting.

Further, advantageously, in accordance with some embodiments, the righting-device can be deployed and retrieved at will. As described above, a cabling system may be provided to enable filling and emptying the righting-device, including retrieving the righting-device from the water when it is desired to be emptied.

Moreover, advantageously, when the life raft is in upright condition, the righting-device does not alter the functionality of the life raft, and any effects are negligible. The water chamber of the righting-device acts as a stabilizing weight, thus stabilizing the life raft when it is tilted at various angles due to an instability event, such as the action of wind or wave force(s). When the life raft is inverted due to a disturbance, the righting-device acts as a self-righting weight acting on one end or side of the life raft. The additional weight supplied by the filled righting-device shifts the center of gravity of the life raft and creates a righting torque coupled with the buoyancy force and helps in making the life raft upright.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, as will be appreciated by those of skill in the art, in some embodiments, the righting-device may be configured as an additional feature along with other standard stabilizing features on a life raft such as water ballasts and sea anchors. Thus, the stability of the life raft may be ensured. For example, when multiple devices or mechanisms are present, the traditional stabilizing elements may help maintain the life raft in a stable upright position, but if a strong enough instability event occurs, the righting-device described herein can ensure that even if the life raft is inverted for a moment, the life raft will automatically right itself to provide proper safety and rescue ability for persons in need.

Further, for example, although shown with the righting-device aligned with one side of the raft and canopy, those of skill in the art will appreciate that the righting-device may be located at any position that will enable the center of gravity to be shifted such that a righting moment may be generated at most, if not all, degrees of inclination of a life raft. For example, although shown with the righting-device directly opposite a point where a canopy is fixed to a buoyancy element, the righting-device may be shifted 90° about the outer circumference of the life raft. Other positions may be used without departing from the scope of the disclosure. It will be appreciated by those of skill in the art that the location of the righting-device may impact the magnitude of a righting moment. For example, in some embodiments shown herein, the position of the righting-device below the canopy may be optimal to extract a maximum righting torque during an instability event.

Further, for example, the shape, dimensions, and configuration of the righting-device may be different from the configurations shown and described herein. That is, although a cylindrical righting-device is shown in the figures, those of skill in the art will appreciate that that righting-device may take any shape or configuration. For example, the righting-device may be formed in a rectangular shape, as a ball or sphere, as a dome shape, etc. The shape, dimensions, geometry, etc. may be optimized and/or changed depending on the specific application and desired amount of additional weight to be supplied by the righting-device.

Further, the shape of the canopy may be altered or changed in order to generate optimal turning moments with the righting-device. For example, the canopy may be configured with a variable cross-section, e.g., a tapered canopy geometry, in order to optimize or increase a righting arm. That is, an increase in the distance between the center of gravity and the center of buoyancy may be generated, thus increasing the righting torque.

Accordingly, the present disclosure is not to be seen as limited by the foregoing description, but is only limited by the scope of the appended claims.

What is claimed is:

1. A life raft comprising:

a base having a top side and a bottom side;

one or more buoyancy elements attached to the top side of the base; and a righting-device attached to the bottom side of the base, the righting-device positioned on the bottom side to cause a shift in a center of gravity when the righting-device is engaged from a first state to a second state, wherein the first state is an unfilled, stowage state and the second state is a filled, deployed state, the righting-device defining a sealable chamber having a valve, the valve operable to allow water to enter the sealable chamber to thus fill the righting-device and transition from the first state to the second state, wherein the shifted center of gravity provides a righting torque to the life raft;

wherein, when the life raft is subject to an instability event, the righting-device generates a righting moment to automatically return the life raft to an upright position, wherein the righting moment is generated over a full 360° of inclination of the life raft.

2. The life raft of claim 1, wherein the valve is openable to allow water to drain from the chamber.

3. The life raft of claim 1, wherein the valve is a two-way check valve.

4. The life raft of claim 1, further comprising an operating cable configured to enable manual operation of the valve between a first position and a second position.

5. The life raft of claim 1, further comprising a canopy attached to the one or more buoyancy elements.

6. The life raft of claim 5, wherein a portion of the canopy attached to the one or more buoyancy elements and the righting-device are positioned on the life raft such that they are aligned on opposite sides of the base.

7. The life raft of claim 1, further comprising a stabilizing device, the stabilizing device configured to stabilize the life raft in an upright position.

8. The life raft of claim 7, wherein the stabilizing device is at least one of ballast and a sea anchor.

9. The life raft of claim 1, wherein the righting-device is configured to expand from a stowage state to a deployed state.

10. The life raft of claim 9, wherein, in the stowage state, the righting-device is empty and can be collapsed and, in the deployed state the righting-device is filled with water.

11. The life raft of claim 1, wherein the righting-device is configured to increase a resistance to overturning of the life raft.

* * * * *